United States Patent [19]

Wang

[11] Patent Number: 4,910,872

[45] Date of Patent: Mar. 27, 1990

[54] HAND-OPERATED COPYING MACHINE

[76] Inventor: Tian-Wang Wang, No. 110-23, Hsin Pin Rd., Tai Pin Shiang, Taichung Hsien, Taiwan

[21] Appl. No.: 376,449

[22] Filed: Jul. 7, 1989

[51] Int. Cl.[4] ..... B43L 13/12

[52] U.S. Cl. ..... 33/23.03

[58] Field of Search ..... 33/23.03

[56] References Cited

U.S. PATENT DOCUMENTS 3,171,207 3/1965 Wormser ..... 33/23.03

3,777,616 12/1973 Mueller ..... 33/23.03

*Primary Examiner*—William A. Cuchlinski, Jr.

*Assistant Examiner*—William C. Dowling

*Attorney, Agent, or Firm*—Varndell Legal Group

[57] ABSTRACT

A hand-operated copying machine which can be efficiently operated to precisely perform copying process is including a frame assembly, a positioning adjusting mechanism and a vertical fixture assembly. The frame assembly includes a copying frame comprising copying tools and pilot rod efficiently controlled by means of a handle. The positioning adjusting mechanism which includes lock screw, scale knob, fixing element and locating element respectively mounted on the positioning holes of a front rod for flexible positioning control of working piece through the adjustment of the scale knob. The vertical fixture assembly includes three locating disc having mounted thereon fixed chuck element, movable chuck element arranged to match with screw bolt and jaw element served to firmly retain the working piece for performing copying process.

2 Claims, 4 Drawing Sheets

HAND-OPERATED COPYING MACHINE

BACKGROUND AND SUMMARY OF THE INVENTION

Conventional copying machine is very simple in design and not very practical in operation. To an elongated working piece, it is very difficult to perform copying process vertically and precisely through conventional copying machine.

The present invention is to provide such a hand-operated copying machine which is very practical for efficiently and precisely performing copying process horizontally as well as vertically on any working piece of any shape thorugh alternative adjustment of a positioning adjusting mechanism, and a vertical fixture assembly.

The objects, features, and advantages of the present invention will become apparent from the following detailed description considered in connection with the annexed drawings as hereunder.

DETAILED DESCRIPTION OF THE PREFERRED EMBODIMENT

Figure 1:
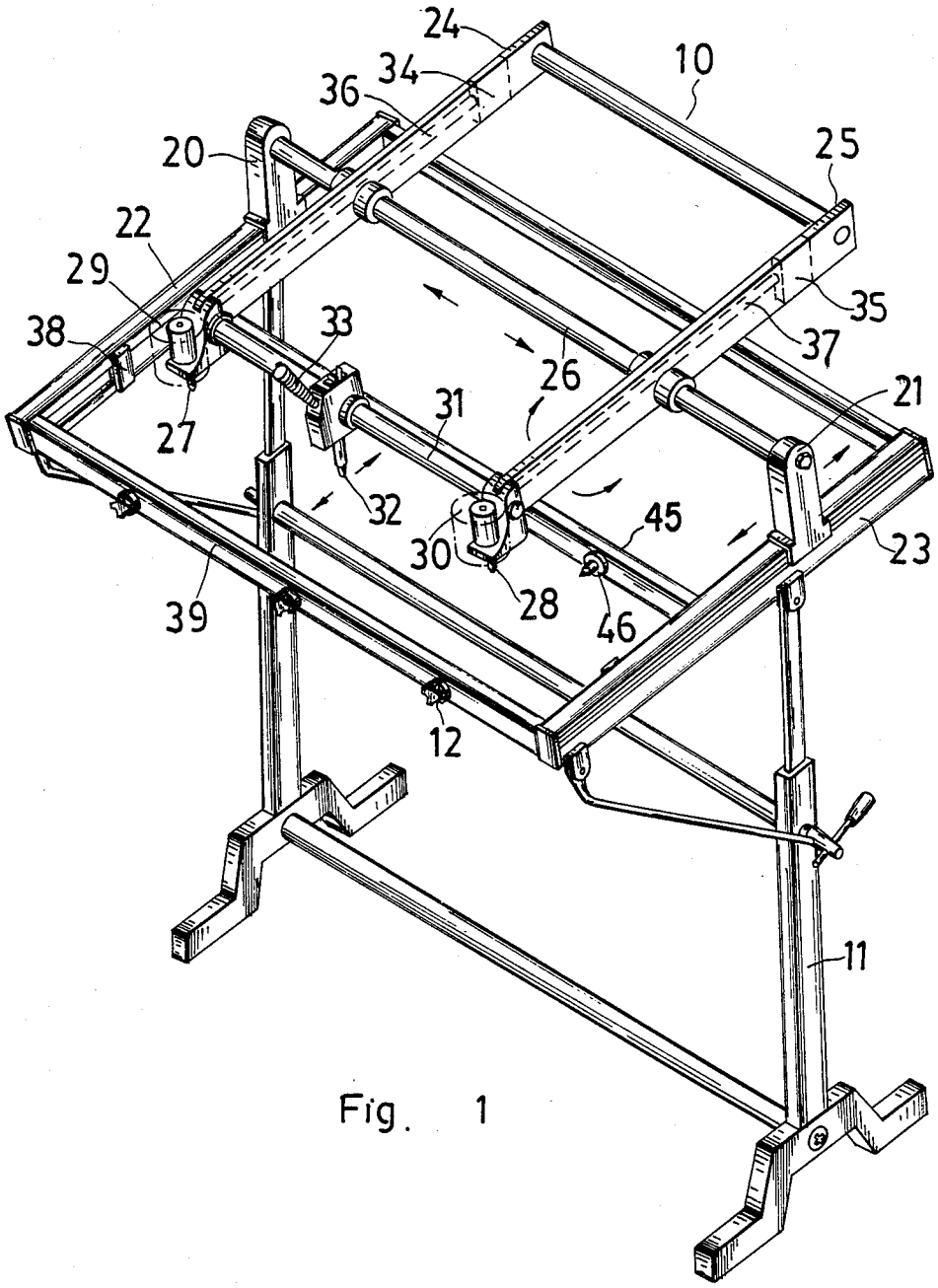
FIG. 1 is a perspective view of a copy machine embodying the present invention.

With reference to FIGS. 1 through 5, a copying machine constructed according to the present invention is comprised of a frame assembly, a positioning adjusting mechanism, and a vertical fixture assembly.

The frame assembly includes a copying frame 10 comprising two opposite sliding blocks 20 and 21 set at both sides to respectively slide along two rails 22 and 23, which are bilaterally mounted on the top of a stand 11, a middle cross rod 26 having both ends respectively connected with the sliding blocks 20 and 21, two hollow side bars 24 and 25 pivotally mounted on the cross rod 26, a pair of copying tool 27 and 28 respectively connected to the two side bars 24 and 25 at the front, which copying tools 27 and 28 are protected by means of respective protective covers 28 and 30, a front cross rod 31 set at the front, a pilot lever 32 mounted on the front cross rod 31 in the middle and controlled by a handle 33, two boring rods 36 and 37 respectively set inside the two hollow side bars 24 and 25, which boring rods 36 and 37 are having one end fixedly connected with the front cross rod 31 and having the other end respectively coupled with two balance weights 34 and 35 to control the balance of the whole frame assembly.

Figure 2:
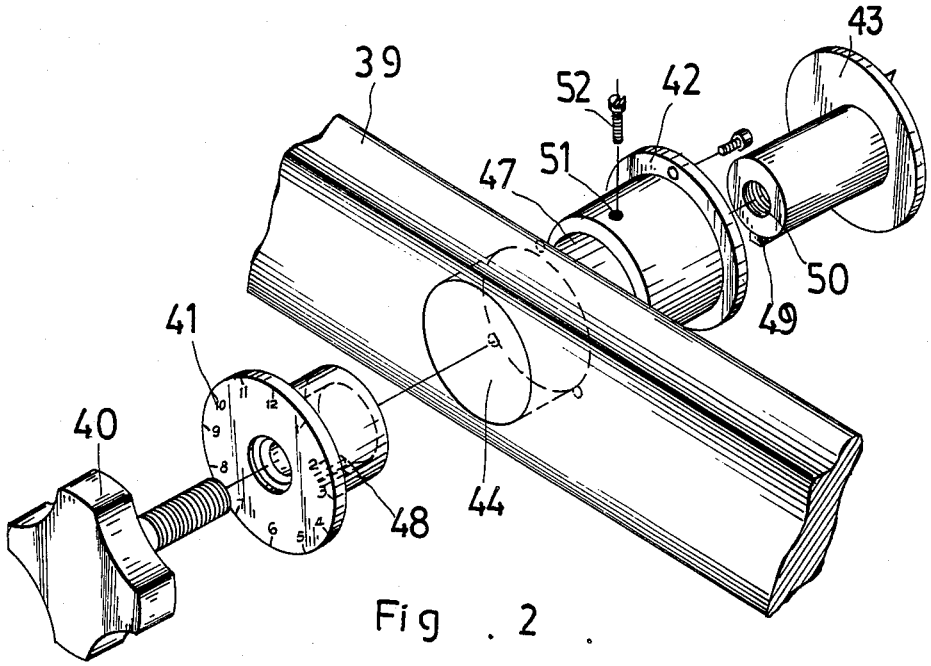
FIG. 2 is a perspective fragmentary view of the adjusting means according to the present invention.

The positioning adjusting mechanism is including two T-blocks 38 bilaterally set on the top of the stand 11 of the frame assembly; a front bar 39 set at the front; three adjusting means 12 equidistantly mounted on the front bar 39, which adjusting means 12, as shown in FIG. 2, are respectively mounted on the positioning holes 44 of the front bar 39, each comprising a lock screw 40, a scale knob 41, a fixing element 42 and a locating element 43; a cross bar 45 set at the top of the stand 11 of the frame assembly; and three locating pins 46 respectively mounted on the cross bar 45. When in assembly, the fixing elements 42 are set in the respective positioning holes 44 and fixedly connected to the front bar 39 by means of screw means. The fixing elements 42 each is having a boring bore 47 for setting therein of the respective scale knob 41 when it is fixedly connected to the front bar 39. The scale knobs 41 each is having a notch 48 made on the inner wall surface for setting therein of the dowel 49 of the associated locating element 43. The locating elements 43 each is having a threaded boring bore 50 for connection with the associated lock screw 40 by means of screw joint. The fixing elements 42 each is also comprising a bolt hole 51 for insertion therethrough of a screw means 52 to fix up the scale knob 41 which is received in its boring bore 47. When the angular position of the working piece is to be adjusted, the screw means 52 are loosened to release the scale knobs 41 from constraint, such that the scale knobs 41 may be turned round to carry the locating elements 43 as well as the working piece to move.

Figure 3:
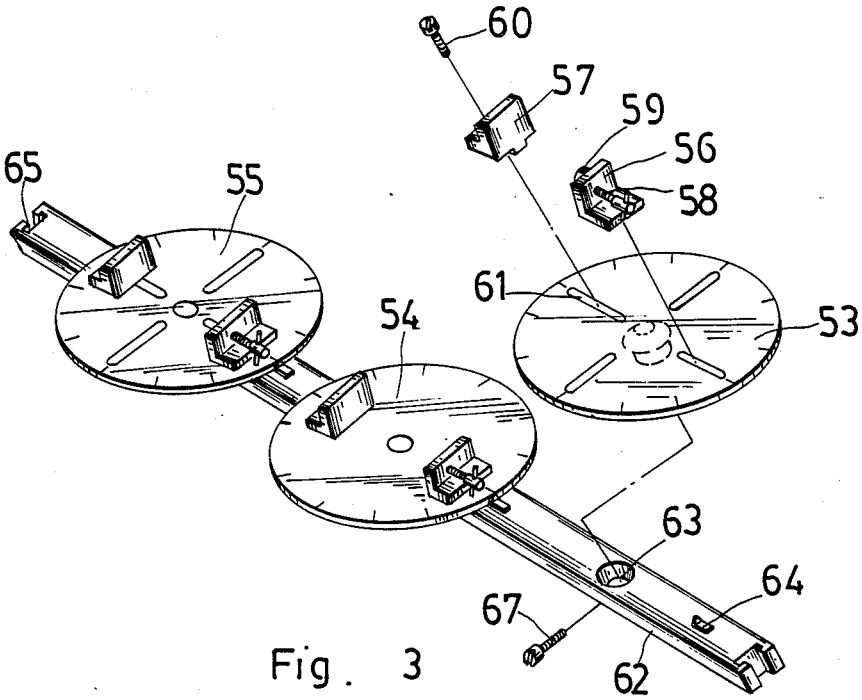
FIG. 3 is a perspective fragmentary view of the vertical fixture assembly according to the present invention.
Figure 4:
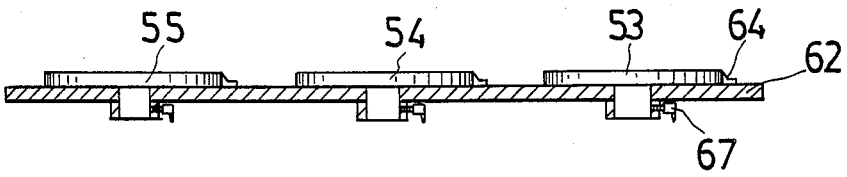
FIG. 4 is a sectional assembly view of the vertical fixture assembly according to the present inveniton.
Figure 5:
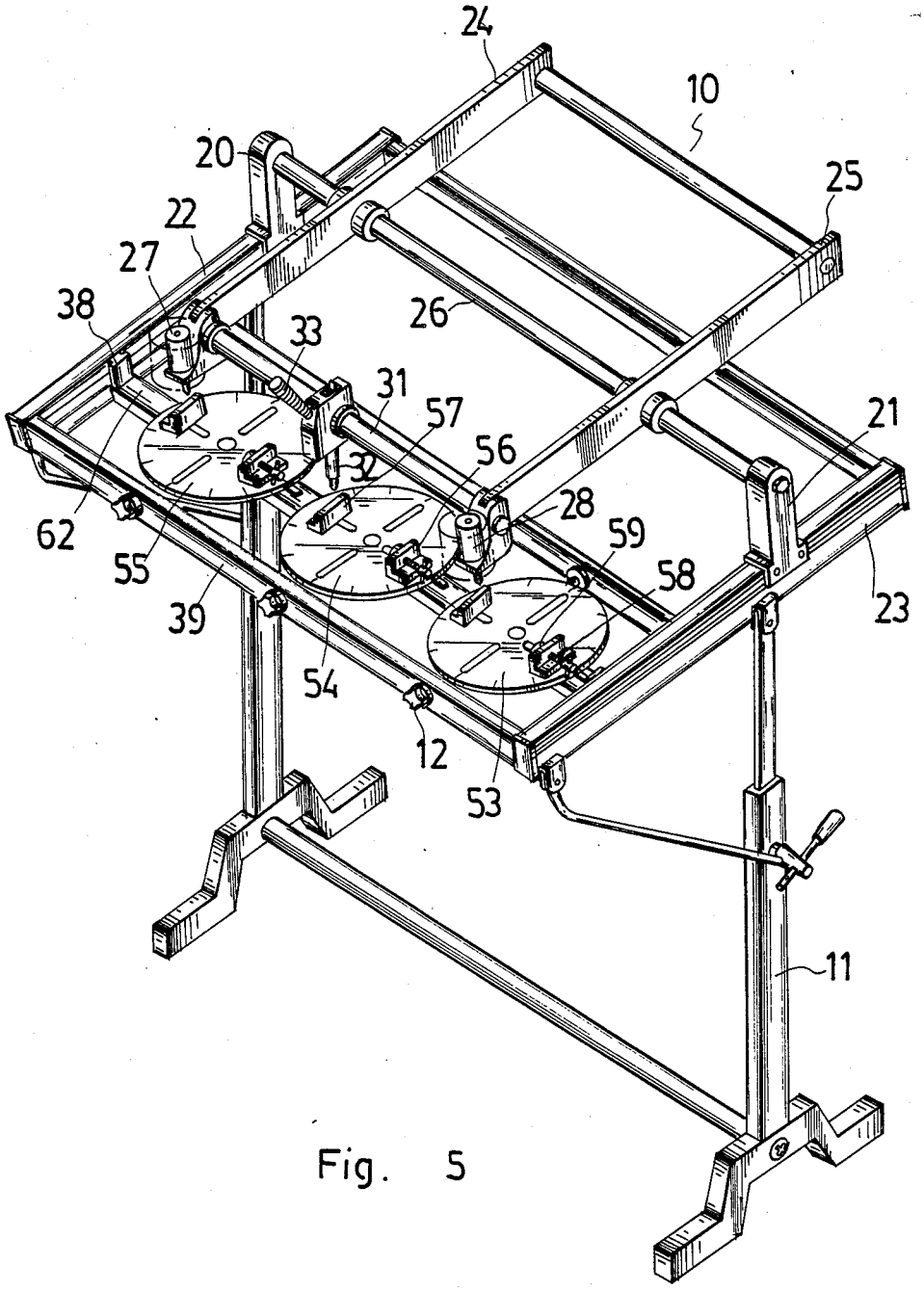
FIG. 5 is a perspective assembly view of the present invention.

The above described adjusting means 12 and the locating pins 46 are for positioning control of horizontal working piece to facilitate the performance of copying process. For the positioning control of vertical working piece, according to the present invention, it is made through a vertical fixture assembly. With reference to FIG. 3, a vetical fixture assembly is including three locating discs 53, 54 and 55 each comprising a fixed chuck element 56 and a movable chuck element 57. The fixed chuck element 56 is having a screw bolt 58 movably mounted thereon, which screw bolt 58 is comprising a jaw plate 59 at the front end. The movable chuck element 57 is movably connected to the elongated slot 61 of the associated locating disc by means of a screw means 60. Through the adjustment of the screw means 60, the position of the movable chuck element 57 may be adjusted along the slot 61 of the associated locating disc accordingly. The locating discs 53, 54 and 55 are having bottom flanges respectively set in the circular holes 63 of a positioning rod 62, which is mounted on the frame assembly, and fixedly connected thereto by means of respective screw means 67. The positioning rod 62 is having indices 64 made thereon and comprising T-shaped notches 65 made on both ends to match with the two T-blocks 38 for positioning when it is mounted on the top of the stand 11. When in operation, the distance between the fixed chuck element 56 and the movable chuck element 57 of each locating disc is properly adjusted according to the size of the working piece. Through the adjusting of the screw bolt 58, the jaw plate 59 is properly controlled to firmly retain the working piece for vertical engraving. When angular position is to be adjusted, the screw means 67 is loosened and therefore, the angular position of the respective locating disc can be easily adjusted so as to let the angular position of the working piece be adjusted accordingly.

According to the present invention, an operator may hold up the handle 33 to drive the engrave control frame 10 to move forward, backward, leftward, rightward, upward or downward to efficiently performing copying process. Through the control of the positioning adjusting mechanism and the vertical fixture assembly, either horizontal or vertical working piece can be processed efficiently.

I claim:

1. A hand-operated copying machine, comprising:

a frame assembly including a copying frame comprising two opposite sliding blocks set at both sides to respectivley slide along two rails which are bilaterally mounted on the top of a stand, a middle cross rod having both ends respectively connected with said sliding blocks, two hollow side bars pivotally mounted on said middle cross rod, a pair of copying tools respectively connected to said two side bars at the front and protected by respective protective covers, a front cross rod set at the front, a pilot lever mounted on said front cross rod in the middle and controlled by a handle, two boring rods respectivley set inside said two hollow side bars, said boring rods having one end fixedly connected with said front cross rod and having the other end respectively coupled with two balance weights;

a positioning adjusting mechanism including two T-blocks bilaterally set on the top of the stand of said frame assembly, a front bar set at the front, three adjusting means equidistantly mounted on the positioning holes of said front bar, said adjusting means each comprising a lock screw, a scale knob, a fixing element and a locating element, a cross bar set at the top of the stand of said frame assembly, and three locating pins respectively mounted on said cross bar; and a vertical fixture assembly including three locating discs each comprising a fixed chuck element and a movable chuck element, said fixed chuck element having mounted thereon a screw bolt comprising a jaw plate at the front end, said movable chuck element being movably connected to the elongated slot of the associated locating disc by means of a screw means, said locating discs also comprising bottom flanges respectively set in the circular holes of a positioning rod, said positioning rod being mounted on said frame assembly and having indices made thereon and comprising T-shaped notches made on both ends to match with said two T-blocks for positioning;

characterized in that through the adjustment of the positioning adjusting mechanism and the vertical fixture assembly, the copying machine is practical for performing copying process on any working piece vertically as well as horizontally.

2. A hand-operated copying machine according to claim 1, wherein the fixing elements each is having a boring bore for setting therein of the respective scale knob, said scale knob having a notch made on its inner wall surface for setting therein of the dowel of the associated locating element, said locating element having a threaded boring bore for connection with the associated lock screw by means of screw joint, said fixing element also comprising a bolt hole for insertion therethrough of a screw means to fix up the scale knob which is received therein.

* * * * *